US007665866B2

(12) United States Patent
Mayer et al.

(10) Patent No.: US 7,665,866 B2
(45) Date of Patent: Feb. 23, 2010

(54) LED LUMINAIRE FOR GENERATING SUBSTANTIALLY UNIFORM ILLUMINATION ON A TARGET PLANE

(75) Inventors: Mark J. Mayer, Sagamore Hills, OH (US); Matthew S. Mrakovich, Streetsboro, OH (US)

(73) Assignee: Lumination LLC, Cleveland, OH (US)

( * ) Notice: Subject to any disclaimer, the term of this patent is extended or adjusted under 35 U.S.C. 154(b) by 237 days.

(21) Appl. No.: 11/778,502

(22) Filed: Jul. 16, 2007

(65) Prior Publication Data

US 2009/0021931 A1 Jan. 22, 2009

(51) Int. Cl.
*F21V 7/00* (2006.01)

(52) U.S. Cl. ..... 362/297; 362/304; 362/241; 362/247

(58) Field of Classification Search ..... 362/235, 362/237, 240, 241, 243, 245, 247, 297, 298, 362/302, 346, 304, 305, 217.05–217.07
See application file for complete search history.

(56) References Cited

U.S. PATENT DOCUMENTS

| | | | | |
|---|---|---|---|---|
| 1,796,468 | A | 3/1931 | Georges | |
| 5,642,933 | A | 7/1997 | Hitora | |
| 5,929,788 | A | 7/1999 | Vukosic | |
| 6,796,695 | B2 * | 9/2004 | Natsume | 362/518 |
| 7,497,600 | B2 * | 3/2009 | Sekela et al. | 362/346 |
| 2003/0193807 | A1 | 10/2003 | Rizkin et al. | |
| 2005/0018429 | A1 * | 1/2005 | Brandenburg et al. | 362/297 |
| 2005/0024870 | A1 | 2/2005 | Coushaine | |
| 2006/0198141 | A1 | 9/2006 | Peck et al. | |
| 2006/0198148 | A1 | 9/2006 | Peck | |
| 2006/0209541 | A1 | 9/2006 | Peck | |
| 2006/0268555 | A1 | 11/2006 | Kelly | |
| 2007/0002572 | A1 * | 1/2007 | Ewig et al. | 362/470 |
| 2008/0247170 | A1 | 10/2008 | Peck | |

FOREIGN PATENT DOCUMENTS

| | | |
|---|---|---|
| FR | 2 913 483 | 9/2008 |

* cited by examiner

*Primary Examiner*—Bao Q Truong
(74) *Attorney, Agent, or Firm*—Fay Sharpe LLP

(57) ABSTRACT

A luminaire includes a fixture housing, a plurality of LEDs disposed on a mounting surface in the fixture housing, and at least one reflector disposed in the housing. A center of each LED is positioned along a line and each LED faces towards an associated target surface that is vertically spaced from the luminaire. The at least one reflector includes first and second reflective surfaces. Each reflective surface is configured with respect to the line on which the LEDs are positioned so that the first reflective surface and the second reflective surface each reflect light from each of the LEDs in a substantially same direction that is offset from a vertical axis.

21 Claims, 8 Drawing Sheets

LED LUMINAIRE FOR GENERATING SUBSTANTIALLY UNIFORM ILLUMINATION ON A TARGET PLANE

BACKGROUND

At step 130, a third reflector is configured to direct light from the second subset of LEDs toward α° and at step 132 a fourth reflector is configured to reflect light from this second subset of LEDs towards α°. For example, with reference back to FIG. 6, the reflective surfaces 36, 38, 42 and 44 are each configured to direct light from a respective ring of LEDs generally towards a direction that is 60° offset from vertical.

Illumination is inversely proportional to the square of the distance between the point light source and the surface to be illuminated, i.e. the target area. Because of this law, a light fixture placed x distance (feet or meters) above a planar target area will require four times the light output in a direction that is offset 60° from the vertical axis as compared to the light output in the vertical axis in order to provide the same luminance at each location. Known light sources, incandescent and arc type lamps, account for this by designing a reflector that directs more light toward the periphery of the target area. This design can be accomplished by assuming that the incandescent or arc type light source is a point light source and then appropriately shaping the reflector to accommodate this point light source.

Light emitting diodes ("LEDs"), on the other hand, are typically not powerful enough so that a single LED, which could act as the point light source similar to the incandescent and arc type lamps, provides sufficient illumination of the target area. This is especially the case where the LED is positioned several feet or meters above the target area. Moreover, LEDs typically do not emit light in a spherical pattern, such as incandescent and arc-type lamps, thus making it difficult to design an appropriate reflector.

To provide sufficient illumination for the target area multiple LEDs can be required to provide the sufficient amount of lumens to provide the minimum luminance to meet the project specifications for the target area. LEDs are typically mounted on a printed circuit board ("PCB") and when a sufficient amount of LEDs are provided on the PCB, however, the size of the PCB required and the number of LEDs required makes it difficult to consider the plurality of LEDs in aggregate as a single point light source. In view of this, it has been known to provide separate optics, either refractive of reflective, for each LED to redirect the light emanating from each LED. Providing a separate optic for each LED can be expensive and also make design of the fixture difficult, especially where it is desirable to provide a light fixture that is easily scalable so that it can be used in a number of different applications.

SUMMARY

A luminaire, according to a first embodiment, includes a fixture housing, a plurality of LEDs disposed on a mounting surface in the fixture housing, and at least one reflector disposed in the housing. A center of each LED is positioned along a line and each LED faces towards an associated target surface that is vertically spaced from the luminaire. The at least one reflector includes first and second reflective surfaces. Each reflective surface is configured with respect to the line on which the LEDs are positioned so that the first reflective surface and the second reflective surface each reflect light from each of the LEDs in a substantially same direction that is offset from a vertical axis.

According to another embodiment, a luminaire includes a fixture housing, a plurality of LEDs disposed on a mounting surface in the fixture housing, and a at least one reflector disposed in the housing and configured to reflect light emanating from each LED and to direct the reflective light toward the associated target surface. A center of each LED is positioned along a line and each LED is directed towards an associated target surface vertically spaced from the luminaire. The at least one reflector includes first and second reflective surfaces. In a cross section taken normal to the line on which the LEDs are disposed, each reflective surface follows along a portion of a conic having a symmetrical axis disposed at an angle other than perpendicular to the mounting surface.

In yet another embodiment, a luminaire for generating substantially uniform illumination on a target surface includes a plurality of LEDs mounted to a support and at least one optic connected to the support. The LEDs and the at least one optic are configured to generate a beam pattern where a first light intensity along an axis is about twenty percent to about thirty percent of a second light intensity that is generated at about fifty degrees to about seventy degrees angularly offset from the axis. The at least one optic cooperates with greater than one LED of the plurality of LEDs to produce the beam pattern.

A method for illuminating a target plane includes providing a luminaire a distance x measured in a vertical axis from a target plane. The method further includes providing a plurality of LEDs on a mounting surface of the luminaire each facing towards the target plane. The method further includes directing light of a first intensity from the plurality of LEDs toward a first area of the target plane that is normal to the vertical axis. The method further includes directing light, via a reflective optic or a refractive optic, of a second intensity from the plurality of LEDs toward a second area of the target plane that is offset from the vertical axis an angle α. The second intensity equals about the inverse of the first intensity multiplied by the square of cosine α.

DETAILED DESCRIPTION

Figure 1:
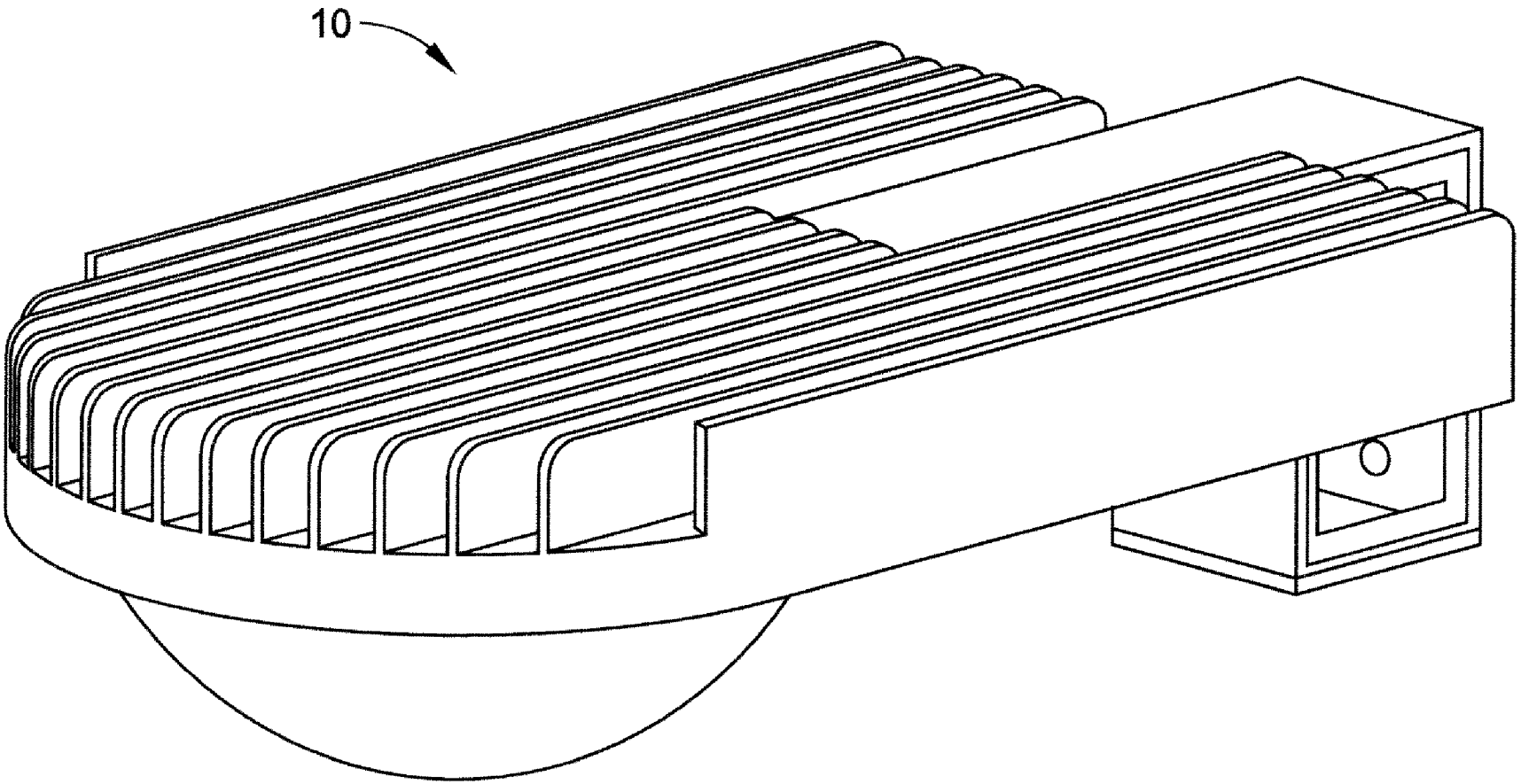
FIG. 1 is a perspective view of a first (upper) side of a luminaire that generates substantially uniform illumination across a target surface.
Figure 2:
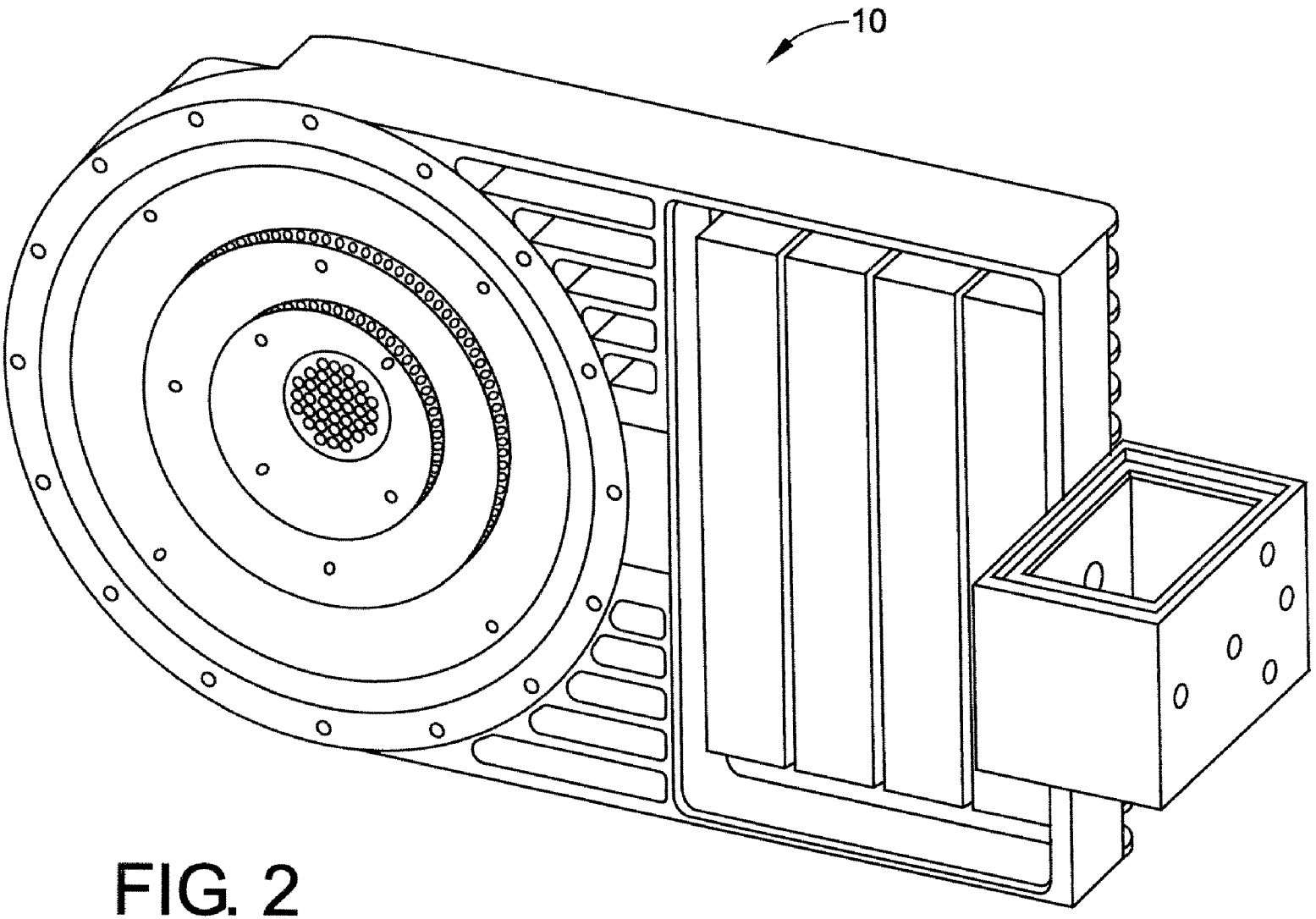
FIG. 2 is a perspective view of a second (lower) side of the luminaire of FIG. 1.
Figure 3:
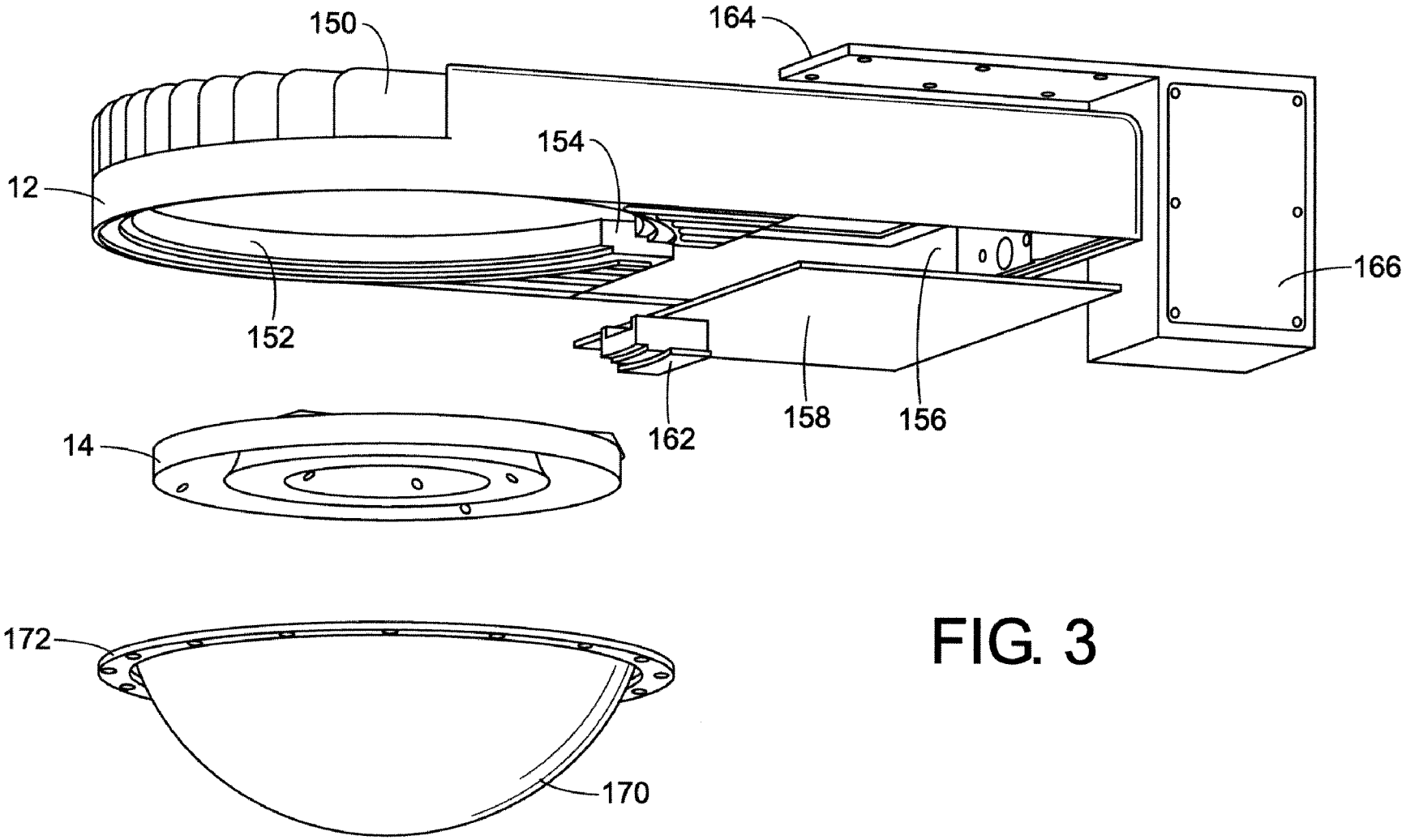
FIG. 3 is an exploded view of the luminaire of FIG. 1.
Figure 4:
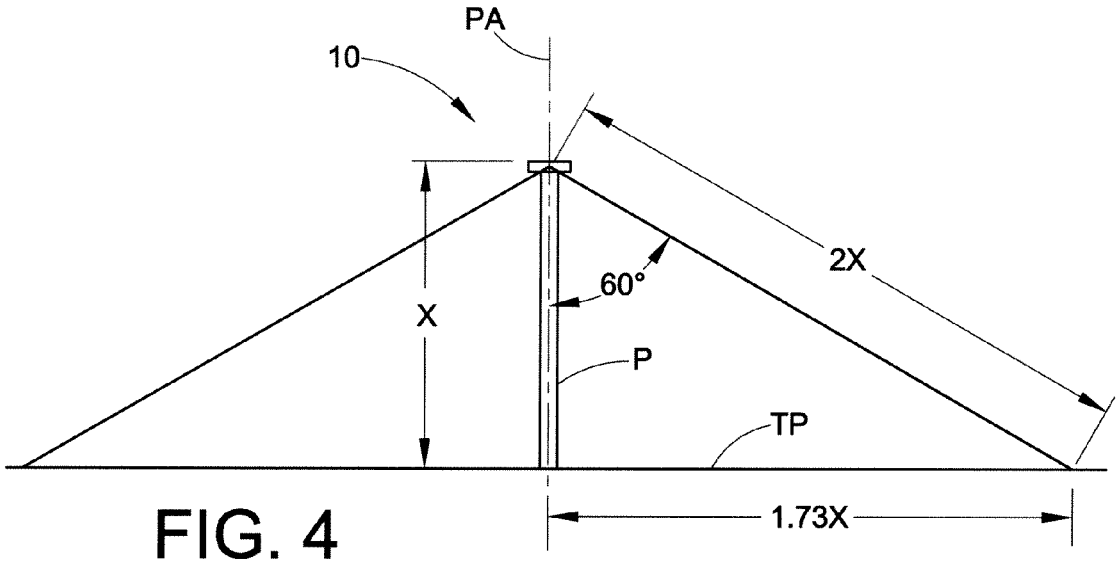
FIG. 4 is a schematic depiction of the luminaire of FIG. 1 mounted to a light pole and illuminating a target plane.

With reference to FIGS. 1 and 2, an example of a luminaire 10 that is capable of providing uniform illumination across a target surface, or target plane, is shown. With reference to FIG. 3, the luminaire includes, among other components, a fixture housing 12 and a reflector/PCB assembly 14 that mounts to the fixture housing. With reference to FIG. 4, the luminaire 10 is configured to mount to a light pole P and illuminate a target plane TP, which can make up a portion of a parking lot, a building floor, a field, etc. Similar to a conventional luminaire that is used to illuminate a target plane, the area that is illuminated by the luminaire 10 of the present embodiment is circular in plan view. Alterations can be made to change the illumination pattern.

With reference to FIG. 4, the luminaire 10 (depicted schematically) mounts to a light pole P and the light pole defines a vertical axis, which will be referred to as the pole axis PA. The luminaire 10 could also mount below the target plane, e.g. the target plane could be a ceiling. In such an instance, or where no pole is provided, the vertical axis is the axis that is centered on the light source of the luminare 10 and is normal to the target pane TP. Since, as mentioned above, illumination is inversely proportional to the square of the distance between a point light source and the surface to be illuminated the lumen output from the point light source in the angular direction 60° offset from the pole axis PA must be four times the lumen output in the vertical direction to provide the same illumination on the target plane at a location directly beneath the light source as at the location on the target plane that is offset 60° from the light pole. Where the luminaire 10 is a great enough distance above (or below) the target plane TP, it can be assumed to act as a point light source. The luminaire 10 is configured to provide greater lumen output away from the vertical axis, i.e. the pole axis PA, to provide more uniform illumination across the target plane TP.

Figure 5:
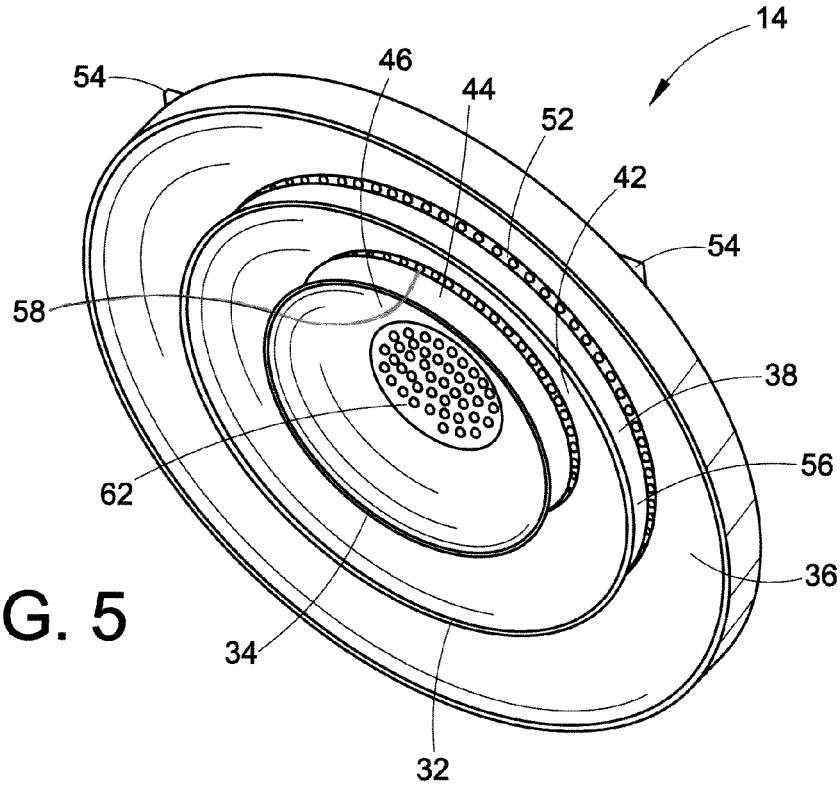
FIG. 5 is a perspective view of a reflector/PCB assembly found in the luminaire of FIG. 1.

With reference to FIG. 5, the reflector/PCB assembly 14 in the depicted embodiment includes an outer reflector 30, an intermediate reflector 32, and an inner reflector 34. The reflectors 30, 32, and 34 can be three separate components, formed as an integral piece or two adjacent reflectors can be formed as an integral piece and the remaining reflector can be a separate piece. The outer reflector 30 forms a first reflective surface 36. The intermediate reflector 32 forms a second reflective surface 38 and a third reflective surface 42. The inner reflector 34 forms a fourth reflective surface 44 and a fifth reflective surface 46. A fewer or a greater number of reflectors and reflective surfaces can be provided.

The reflector/PCB assembly 14 in the depicted embodiment also includes LEDs mounted to a mounting surface 52 of a PCB 54. The LEDs all face toward the target plane TP (FIG. 4, i.e. downward in the example shown in FIG. 4). The LEDs mount to the mounting surface 52, which is planar, of the PCB 54 so that an outer set 56 of LEDs have their centers disposed along a line, an intermediate set 58 have their centers positioned along a line, and an inner set 62 are formed in an array. More particular to the depicted embodiment, the outer LED set 56 forms a ring, or circle, and cooperates with the first reflective surface 36 and the second reflective surface 38. The intermediate LED set 58 forms a ring, or circle, and cooperates with the third reflective surface 42 and the fourth reflective surface 44. The inner LED set 62 cooperates with the fifth reflective surface 46.

Figure 6:
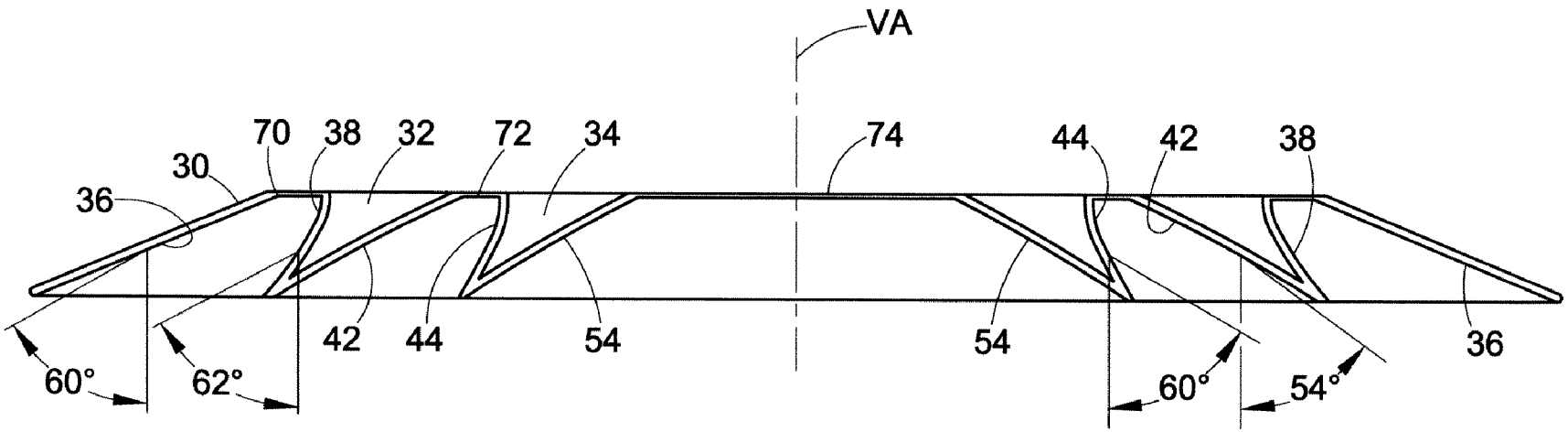
FIG. 6 is a cross-sectional view of reflectors of the reflector/PCB assembly.

As more clearly seen in FIG. 6, the outer reflector 30 and the intermediate reflector 32 define an outermost aperture 70 disposed between these reflectors. In a depicted embodiment, the outermost aperture 70 is circular so that the outer set 56 of LEDs are disposed in this aperture 70. Similarly, the intermediate reflector 32 is spaced from the inner reflector 34 to define an intermediate circular aperture 72 that receives the intermediate LED set 58. The inner 34 reflector includes a circular opening 74 to receive the inner LED set 62. The apertures 70, 72 and 74 are concentric about the vertical axis VA of the luminaire 10. As more clearly seen in FIG. 6, the second reflective surface 38 and the third reflective surface 42 share a common edge and the fourth reflective surface 44 and the fifth reflective surface 54 also share a common edge.

The outer LED set 56 is disposed on the PCB 54 so that their centers form a circle that is concentric about a central axis VA of the luminaire 10, which is parallel with the pole axis PA when the luminaire is mounted to a pole (see FIG. 4). Likewise the intermediate LED set 58 is disposed on the PCB 54 so that their centers form a circle that is concentric about a central axis VA of the luminaire. The reflective surfaces 36, 38, 42, 44 and 46 are each formed having an axis of revolution that is concentric with the central axis of the luminaire 10.

The outer LED set 56 and the first and second reflective surfaces 36, 38 are configured and positioned with respect to one another to direct light toward an area of the target plane TP that is angularly offset from the pole axis PA. The angular offset is the internal angle measured between the vertical axis VA of the luminaire, which is typically parallel to the pole axis PA, and the angle at which light is reflected from a respective reflective surface. More particularly, since four times the lumen output is required to illuminate the area of the target plane that is angularly offset 60° from the pole axis PA as compared to the area of the target plane directly beneath the luminaire 10, the first reflector surface 36 and the second reflector surface 38 have a conic section configuration (more specifically a parabolic configuration in a cross section taken normal to the line on which the outer LED set 56 resides—see FIG. 6) that is configured to direct light that reflects off of the first and second reflective surfaces at about 60° (e.g. about 50° to about 70°, and more preferably about 55° to about 65°) from vertical. More particularly, the first reflective surface 36 and the second reflective surface 38 direct light in a substantially identical angular direction toward an area on the associated target surface. For example, in the embodiment depicted the first reflective surface 36 is configured to direct light at about 60° from vertical and the second reflective surface 38 is configured to direct light at about 62° from vertical. Accordingly, the first reflective surface 36 and the second reflective surface 38 direct light in a substantially identical angular direction. The differences between the direction at which the first reflector is configured to direct light and the direction at which the second reflector is configured to direct light is a function of how closely the intensity at the target plane matches the "perfect distribution" intensity, which will be discussed in more detail below (see FIG. 8).

Likewise, the intermediate LED set 58 and the third and fourth reflective surfaces 42, 44 are configured and positioned with respect to one another to direct light toward an area of the target plane TP that is angularly offset from the pole axis PA. The third reflector surface 42 and the fourth reflector surface 44 have a conic section configuration (more specifically a parabolic configuration in a cross section taken normal to the line on which the intermediate LED set 58 resides—see FIG. 6) that is configured to direct light that reflects off of the third and fourth reflective surfaces at about 60° (e.g. about 50° to about 70°) from vertical. For example, in the embodiment depicted the third reflective surface 42 is configured to direct light at about 54° from vertical and the fourth reflective surface 44 is configured to direct light at about 60° from vertical. Accordingly, the third reflective surface 42 and the fourth reflective surface 44 direct light in a substantially identical angular direction. The differences between the direction at which the third reflector is configured to direct light and the direction at which the fourth reflector is configured to direct light is a function of how closely the intensity at the target plane matches the "perfect distribution" intensity, which will be discussed in more detail below (see FIG. 8).

Accordingly, the outer LED set 56 and the intermediate LED set 58 can illuminate, generally, the same portion of the target plane. If desired, however, the shape of the reflectors can be altered so that the first LED set 56 illuminates a first portion or swath of the target plane and the second LED set 58 illuminates a second portion or swath of the target plane. Moreover, the shape of the individual reflectors can be altered to direct light where it is most needed to provide the most uniform illumination over the entire target plane.

Figure 8:
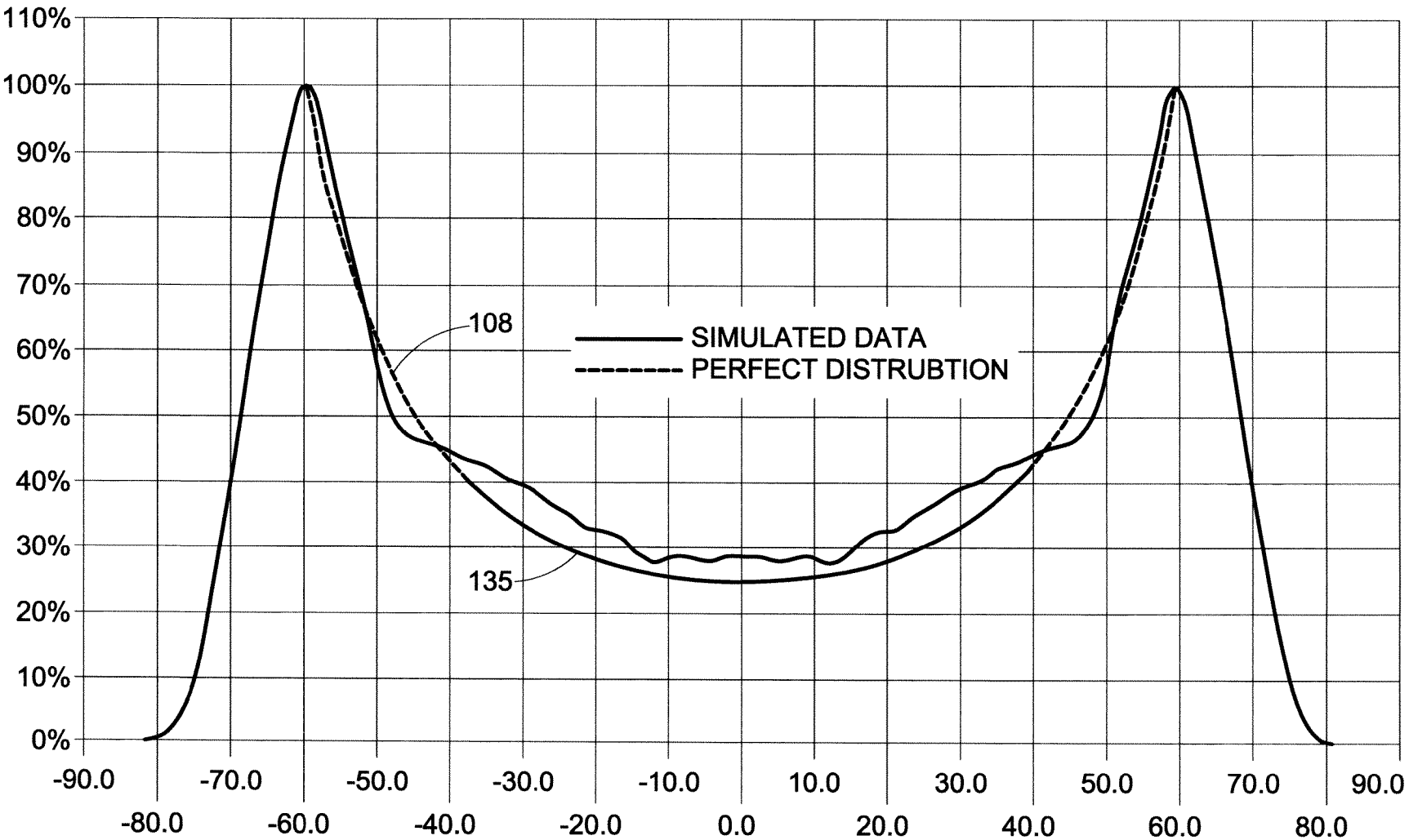
FIG. 8 is a graph showing a theoretical perfect luminous intensity at different angles with respect to a vertical axis and simulated data of luminous intensity at different angles with respect to a vertical axis for the luminaire shown in FIG. 1.

The inner LED set 62, which is in the form of an array and centrally disposed on the mounting surface 52 of the PCB 54, along with the fifth reflective surface 46, direct light to illuminate the central area of the target plane TP, i.e. the circular area of the target plane between the 60° offset location of the target plane and the pole axis PA. Much of the target plane that is illuminated between the portion of the target plane that offset 60° to the left in FIG. 4 and the portion of the target plane that is offset 600 to the right in FIG. 4 is illuminated by the third LED set 62 and this light is not reflected by a reflector of the luminaire. The fifth reflective surface 54 is used to direct light to more closely match "perfect distribution" intensity, which is shown in FIG. 8.

The design of the luminaire is scalable. If more light intensity is needed at the target plane TP, more LEDs (or higher powered LEDs) can be added to the luminaire 10. By using the reflectors and situating the LEDs in rings, or lines, around the central LED array, i.e. the central LED set 62 in the depicted embodiment, the additional rings or lines of LEDs can be used to illuminate the portion of the target plane that requires a greater lumen output to maintain uniform illuminance across the target plane. If more light intensity is needed at the outer edges of the target plane, then additional LED rings, e.g. in addition to the outer LED set 56 and the intermediate LED set 58, and additional reflectors can be added to the luminaire 10.

In addition to being scalable, the luminaire 10 can also be designed to provide a beam pattern that is a shape other than circular. For example, the reflector/PCB assembly 14 can be cut in half, e.g. at the axis VA in FIG. 6, to provide a semicircular shaped beam pattern. The reflectors can also take alternative configurations to provide a rectangular or square shaped beam pattern. Generally, ¼ of the light output flux from the luminaire is directed towards the center of the target plane as compared to the light output flux that is directed toward the periphery of the target plane, which provides four times the light output at a location on the target plane that is angularly offset 60° from vertical.

Figure 7:
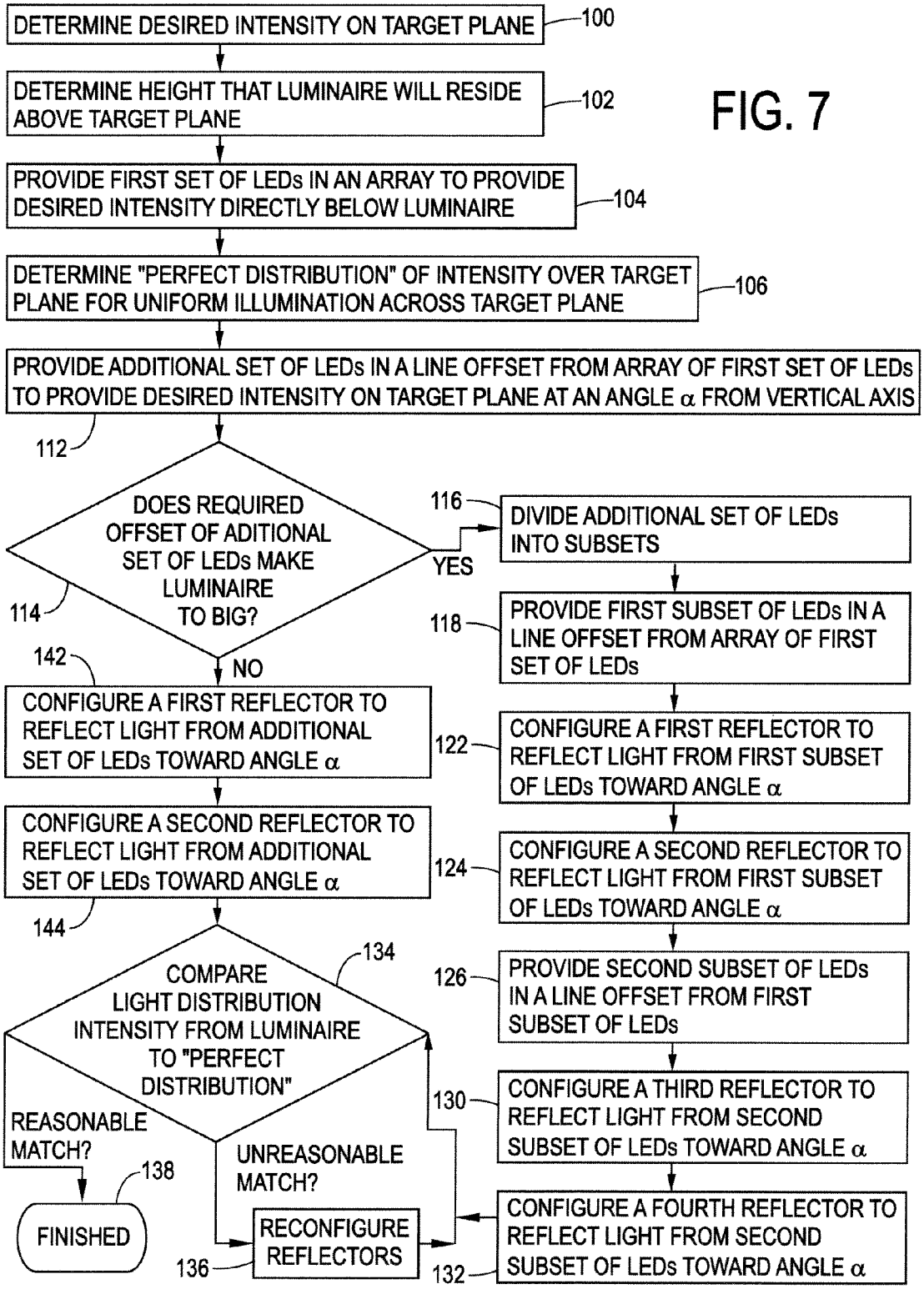
FIG. 7 is a flow chart showing an example of a method that can be used to design the luminaire shown in FIG. 1.

With reference to FIG. 7, the luminaire 10 can be designed in the following manner. At step 100, the desired intensity threshold for the target plane TP is determined, which is typically equal to a minimum luminance (candela per square foot or meter) required by the design. At step 102, the height x that the luminaire 10 will reside above the target plane TP is then determined. This can often be a function of the minimum pole height allowed for a parking lot application or the ceiling height if the luminaire is located in a building. At step 104, the number (and power) of LEDs required to provide the desired intensity threshold at a location directly below (or above) the luminaire is determined. These LEDs can coincide with the central LED set 62 shown in FIG. 5. Since the height x will typically greatly exceed the plan dimensions of the array for the central LED set 62, the central LED set (as well as all the LEDs for the luminaire 10) can be assumed to act as a point light source.

At step 106, the "perfect distribution" of intensity over the target plane TP for uniform illumination across the target plane is determined. With reference to FIG. 8, "perfect distribution" is shown as line 108 where relative intensity is plotted in the vertical axis and the angular offset is depicted in the horizontal axis. The "perfect distribution" is determined using the relationship of the cosine of the internal angle between the pole axis and the direction at which light is emitted from the luminaire and the fact that illumination is inversely proportional to the square of the distance between a point light source and the surface to be illuminated. Since uniform illumination is desired across the target plane, the luminous flux generated at a particular angle can be determined.

With reference back to FIG. 7, at step 112, an additional set of LEDs, which coincides with either outer LED set 56 or the intermediate LED set 58, is provided in a line offset from the LED array, e.g. the central LED set 62, to provide a desired intensity on the target plane at an angle $\alpha$ from the vertical axis. At step 114, it is determined whether the required offset of the additional LEDs in the line, which would typically be formed in a circle, would make the luminaire 10 too big. If the luminaire would be too big or the offset be too great, then at step 116 the additional sets of LEDs are broken into subsets, which can coincide with the outer LED set 56 and the intermediate LED set 58.

Where multiple LED sets are required, at step 118, the first subset of LEDs can be provided in a line offset from the array (the outer LED set 56 can be positioned away from the central LED set 62). At step 122, a first reflector is configured to reflect the light from the first subset of LEDs (which coincides with the outer LED set 56) (FIG. 5) toward the $\alpha°$. To reflect light toward the $\alpha°$, the reflector is provided having a conic shape where the line in which the first subset of LEDs is located on the focus of the conic section to provide a collimated beam pattern directed in the direction of $\alpha°$. To provide a more easily manufactured reflector, the reflector can then be cut or truncated so that the reflector follows only a portion of this conic section, which still allows the reflector to direct light towards the $\alpha°$. As more clearly seen in FIG. 6, each reflective surface is truncated in a plane that is parallel to the mounting surface 54 of the PCB 56. The conic section, e.g. parabola is tilted with respect to the vertical axis VA so that light that contacts in the reflective surface is directed towards the angular direction $\alpha°$.

At step 124, a second reflector is configured to reflect light from the first subset of LEDs toward $\alpha°$. In other words, with reference back to FIG. 6, the first reflective surface 36 can be configured to direct light generally 60° offset from vertical and the second reflective surface 38 is configured to direct light generally 62° from vertical. Both of the reflective surfaces 36 and 38, as well as reflective surfaces 42 and 44, generally follow a conic section where the conic (which in this case is a parabola) has its symmetrical axis tilted toward the direction in which it is desired to direct light, e.g. about 60° from the vertical axis. Again, this conic shaped reflector can also be cut or truncated.

At step 126, a second subset of LEDs (which can also be placed in a ring around the first subset as well as the central array) is provided in a line offset from the first subset of LEDs. For example, with reference to FIG. 5, the central LED set 58 is disposed inside the outer LED set 56 and each are formed in a circle that is concentric about a symmetrical axis of the luminaire.

At step 132, a third reflector is configured to direct light from the second subset of LEDs toward $\alpha°$ and at step 132 a fourth reflector is configured to reflect light from this second subset of LEDs towards α°. For example, with reference back to FIG. 6, the reflective surfaces 36, 38, 42 and 44 are each configured to direct light from a respective ring of LEDs generally towards a direction that is 60° offset from vertical.

Light distribution from this luminaire is then compared to the perfect distribution at step 134. For example, simulated data, which can be derived using known computer modeling programs, is shown at line 135 in FIG. 8 that closely matches the perfect distribution. If the luminaire is designed such that there is not a reasonable match between the simulated data and the perfect distribution, then at step 136 the reflectors can be reconfigured in an effort to more closely match a perfect distribution. The light distribution can then be modeled again and compared at step 134. If a reasonable match occurs then at step 138 the luminaire design is finished.

With reference back to step 114, if the required offset or additional LEDs do not make the luminaire too big, then at step 142 a first reflector is configured for the additional set of LEDs. The design of this reflector is similar to the step 118 described above. Additionally, at step 144 a second reflector is configured to reflect light from the additional set of LEDs toward α° and then this design luminaire is compared to the perfect distribution.

Figure 9:
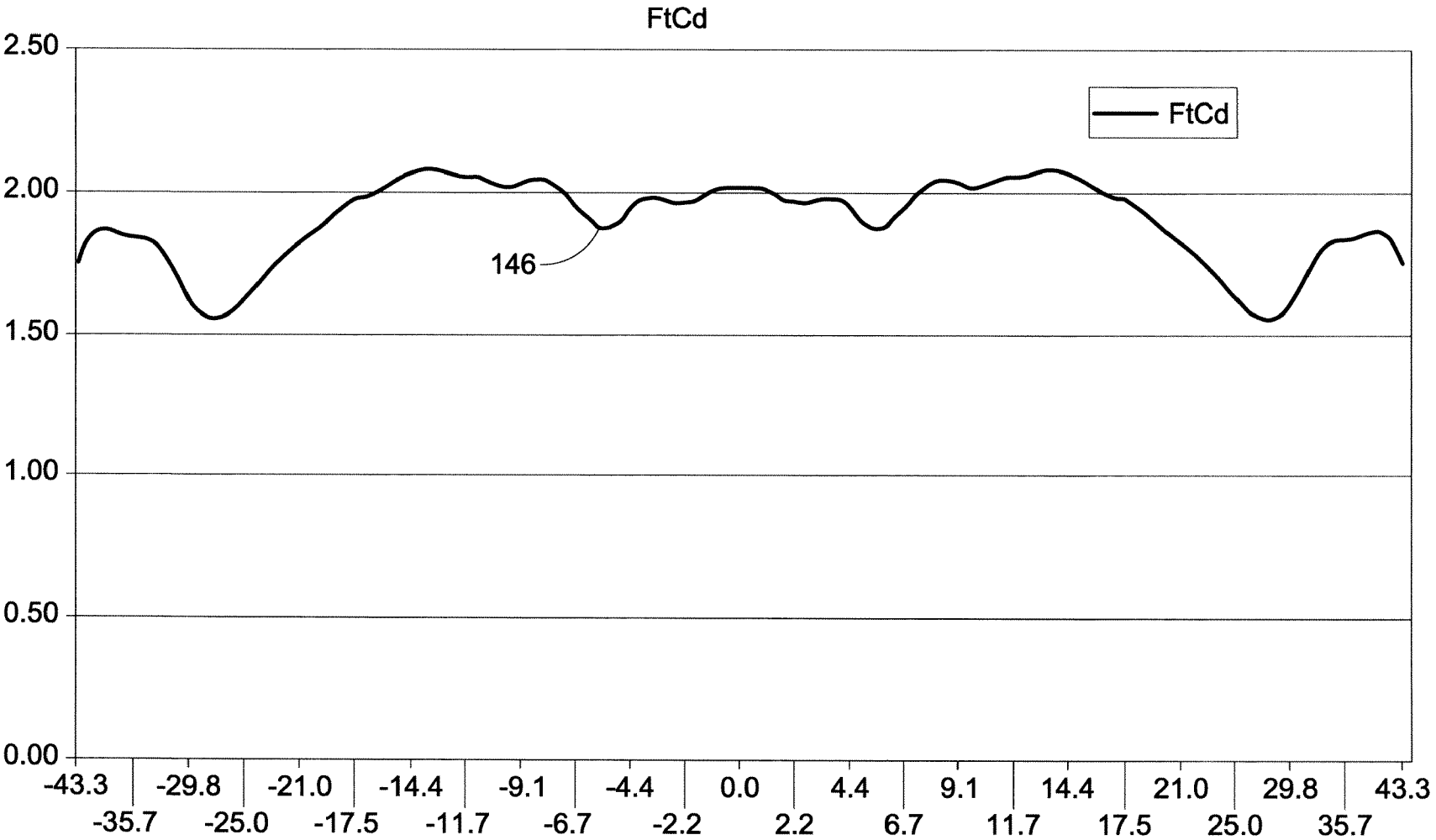
FIG. 9 is a graph showing the luminance across the target plane generated by the luminaire shown in FIG. 1.

FIG. 9 shows illumination across a target plane at line 146 which measures foot candles across a target plane where the luminaire is disposed 25 feet (or meters) above the target plane. As can be seen in FIG. 9, the distribution across the target plane is generally uniform illumination across the target plane.

With reference back to FIG. 3, the fixture housing is typically made of metal and includes a plurality of fins 150 that provide a heat dissipating function for the luminaire. The fixture housing 12 also includes a circular recess, which can take alternative configurations, to receive the reflector/PCB assembly 14. The reflector housing also includes a passage 154 that leads to an electrical panel recess 156. The electrical panel recess receives power conditioning electronics (not shown) that can condition line voltage to provide the appropriate current and voltage to the LEDs of the reflector/PCB assembly 14. An electrical panel cover 158 covers the electrical panel recess 156. A fixture wire pass cover 162 covers the passage 154 between the circular recess 152 and the electrical panel recess 156. Wires (not shown) connecting the PCB 56 to the power conditioning electronics pass through this passage 154. The fixture housing 12 attaches to a mounting bracket 164 to attach to a light pole. A mounting box cover 166 is provided to cover a hollow portion of the mounting bracket which can store wires in other components.

A spherical cover 170 attaches to the fixture housing 12 to cover the reflector/PCB assembly 14. A retaining ring 172 is used to affix the electrical cover 170 to the fixture housing 12. The spherical cover 170 is designed so that light is neither reflected nor refracted as it passes through the spherical cover 170. Accordingly, in this instance the cover 170 has a spherical shape to accommodate the polar angles at which light is being emitted from the reflector/PCB assembly 14.

As mentioned above, the design for the luminaire 10 is scalable. Moreover, the luminaire can be slightly reconfigured to utilize refractive optics instead of reflective optics. In such an instance, lenses, which would be circular if a circular beam pattern were desired, would be provided over the rings of LEDs to refract the light towards the desired angle. If a narrower beam pattern is desired, the optics, whether it be a reflective or refractive optics, can be configured to direct the light at angles that are greater than 60° or less than 60°. The embodiment shown and described is one specific example of a luminaire that can provide a general uniform illumination across a target plane.

The broad concepts discussed herein will be apparent to those skilled in the art after having read this description. Rather than using an optic for each LED or a macro optic for the entire array, the luminaire described uses a hybrid approach that creates portions of the beam pattern from portions of the LED array. The light is redirected from these portions of the LED array using reflectors that are aimed to purposely fill portions of the beam pattern. The design can be modular to provide a "D" shaped beam pattern, for example, as well as other beam patterns. The invention has been particularly described with reference to one embodiment and alternatives have been discussed. The invention, however, is not limited to only the particular embodiment described or the alternatives described herein. Instead, the invention is broadly defined by the appended claims and the equivalents thereof.

The invention claimed is:

1. A luminaire comprising:

a fixture housing;

a plurality of LEDs disposed on a mounting surface in the fixture housing, a center of each LED positioned along a line and each LED facing towards an associated target surface vertically spaced from the luminaire; and at least one reflector disposed in the housing including first and second reflective surfaces, each reflective surface being configured with respect to the line on which the LEDs are positioned so that the first reflective surface and the second reflective surface each reflect light emanating from each of the LEDs located on the same line in a substantially same direction that is offset α° from a vertical axis.

2. The luminaire of claim 1, wherein each reflective surface has a configuration of at least a partial conic section, wherein the focus of a conic that overlaps the at least a partial conic section intersects the line on which the LEDs are positioned.

3. The luminaire of claim 1, wherein the line is curved and the first reflective surface and the second reflective surface remain parallel to the line.

4. The luminaire of claim 1, wherein the line forms a circle and the reflective surfaces each form a surface about an axis of revolution that is concentric with the center of the circle.

5. The luminaire of claim 1, further comprising an additional plurality of LEDs that are not disposed along the line and the at least one reflector further includes an additional reflective surface, the additional plurality of LEDs and the additional reflective surface cooperating with one another to direct light in an area of the target surface between vertical and α°.

6. A luminaire comprising:

a fixture housing;

a plurality of LEDs disposed on a mounting surface in the fixture housing, a center of each LED positioned along a line and each LED being directed towards an associated target surface vertically spaced from the luminaire; and at least one reflector disposed in the housing and configured to reflect light emanating from each LED and to direct the reflected light at an angle of about 50° to about 70° offset from the associated target surface, the at least one reflector including first and second reflective surfaces, in a cross section taken normal to the line on which the LEDs are disposed each reflective surface follows along a portion of a conic having a symmetrical axis disposed at an angle other than perpendicular to the mounting surface.

7. The luminaire of claim 6, wherein the plurality of LEDs include a first set of LEDs disposed along a first line and a second set of LEDs disposed along a second line, wherein the first reflective surface and the second reflective surface reflect light from the first set of LEDs located along the first line, and the at least one reflector includes a third reflective surface and a fourth reflective surface configured to reflect light from the second set of LEDs located along the second line.

8. The luminaire of claim 7, wherein the first line and the second line each form a respective circle.

9. The luminaire of claim 8, wherein the second reflective surface and the third reflective surface share a common edge.

10. The luminaire of claim 9, further comprising a further plurality of LEDs disposed inside the circle formed by the second line.

11. The luminaire of claim 10, wherein the at least one reflector includes a fifth reflective surface configured to reflect light emanating from the further plurality of LEDs disposed inside the circle formed by the second line.

12. The luminaire of claim 11, wherein the fourth reflective surface and the fifth reflective surface share a common edge.

13. A luminaire for generating substantially uniform illumination on a target surface comprising a plurality of LEDs mounted to a support and at least one optic connected to the support, the LEDs and the at least one optic being configured to generate a beam pattern where a first light intensity along an axis is about 20% to about 30% of a second light intensity that is generated at about 50% to about 70% angularly offset from the axis, wherein the at least one optic cooperates with greater than one LED of the plurality of LEDs to produce the beam pattern.

14. The luminaire of claim 13, wherein the at least one optic includes a reflector.

15. The luminaire of claim 13, wherein the plurality of LEDs are disposed along a first line and a second line that is spaced from the first line.

16. The luminaire of claim 15, wherein the at least one optic includes a first reflective surface, a second reflective surface, a third reflective surface and a fourth reflective surface, wherein the first reflective surface and the second reflective surface reflect light from respective LEDs located along the first line, and the third reflective surface and the fourth reflective surface are configured to reflect light from respective LEDs located along the second line.

17. The luminaire of claim 16, wherein the first line and the second line each form a respective circle.

18. The luminaire of claim 17, further comprising a further plurality of LEDs disposed inside the circle formed by the second line.

19. The luminaire of claim 18, wherein the at least one reflector includes a fifth reflective surface configured to reflect light emanating from the further plurality of LEDs disposed inside the circle formed by the second line.

20. A method for illuminating a target plane comprising:

providing a luminaire a distance measured in a vertical axis from a target plane;

providing a plurality of LEDs on a mounting surface of the luminaire each facing towards the target plane;

directing light of a first intensity from the plurality of LEDs toward the first area of the target plane that is normal to the vertical axis; and directing light, via a reflective optic or a refractive optic, of a second intensity from the plurality of LEDs toward a second area of the target plane that is offset from the vertical axis an angle $\alpha$, wherein the second intensity equals about the inverse of the first intensity multiplied by the square of cosine $\alpha$.

21. A luminaire comprising:

a fixture housing;

a plurality of LEDs disposed on a mounting surface in the fixture housing, a center of each LED positioned along a line and each LED facing towards an associated target surface vertically spaced from the luminaire; and at least one reflector, including a first and second reflector surface, disposed in the housing and configured to reflect light emanating from each LED, wherein the plurality of LEDs include a first set of LEDs disposed along a first line and a second set of LEDs disposed along a second line, wherein the first reflective surface and the second reflective surface reflect light from the first set of LEDs located along the first line, and the at least one reflector includes a third reflective surface and a fourth reflective surface configured to reflect light from the second set of LEDs located along the second line.

* * * * *